US008522791B2

(12) United States Patent
Neumann

(10) Patent No.: US 8,522,791 B2
(45) Date of Patent: Sep. 3, 2013

(54) DEVICE FOR FILLING CIGARETTE TUBES

(75) Inventor: Manfred Neumann, Radevormwald (DE)

(73) Assignee: Gizeh Raucherbedarf GmbH, Gummersbach (DE)

( * ) Notice: Subject to any disclaimer, the term of this patent is extended or adjusted under 35 U.S.C. 154(b) by 375 days.

(21) Appl. No.: 13/120,658

(22) PCT Filed: Jul. 9, 2009

(86) PCT No.: PCT/EP2009/058747
§ 371 (c)(1), (2), (4) Date: Mar. 24, 2011

(87) PCT Pub. No.: WO2010/034533
PCT Pub. Date: Apr. 1, 2010

(65) Prior Publication Data
US 2011/0192406 A1 Aug. 11, 2011

(30) Foreign Application Priority Data
Sep. 26, 2008 (DE) ..... 20 2008 012 816 U

(51) Int. Cl.
*A24C 5/00* (2006.01)
*A24C 5/18* (2006.01)

(52) U.S. Cl.
USPC ..... 131/70; 131/84.1; 131/84.2

(58) Field of Classification Search
USPC ..... 131/70–75, 84.1–84.4
See application file for complete search history.

(56) References Cited

U.S. PATENT DOCUMENTS

| | | | | |
|---|---|---|---|---|
| 3,699,975 | A | 10/1972 | Saraber | |
| 5,398,701 | A * | 3/1995 | Neumann et al. | 131/70 |
| 6,978,789 | B2 * | 12/2005 | Garbarino | 131/70 |
| 7,066,183 | B2 * | 6/2006 | Parcevaux | 131/70 |
| 2004/0099276 | A1 | 5/2004 | Parcevaux | |
| 2004/0200485 | A1 | 10/2004 | Garbarino | |

FOREIGN PATENT DOCUMENTS

| | | | |
|---|---|---|---|
| CA | 2 424 881 | A | 10/2004 |
| DE | 1945498 | A1 | 3/1971 |
| DE | 4110830 | C1 | 5/1992 |
| DE | 60307021 | T2 | 12/2006 |

* cited by examiner

*Primary Examiner* — Richard Crispino
*Assistant Examiner* — Eric Yaary
(74) *Attorney, Agent, or Firm* — Norman B. Thot

(57) ABSTRACT

An apparatus for filling a prefabricated cigarette tube includes a housing, a tobacco chamber with a tobacco holder, and a movable pressing bar configured so as to form tobacco introduced into the tobacco chamber into a tobacco strand. An abutment for an end of the tobacco strand is assigned to the tobacco holder, wherein a first length of the to be formed tobacco strand is adjustable to prefabricated cigarette tubes having different filling-cavity lengths by adjusting a second length of the pressing bar. A slider is configured to be moved relative to the housing so as to fill the prefabricated cigarette tube with the tobacco strand. The tobacco holder is displacably arranged relative to the abutment in a movement direction of the slider by a distance which approximately corresponds to the different filling-cavity lengths.

15 Claims, 4 Drawing Sheets

DEVICE FOR FILLING CIGARETTE TUBES

CROSS REFERENCE TO PRIOR APPLICATIONS

This application is a U.S National Phase application under 35 U.S.C. §371 of International Application No. PCT/EP2009/058747, filed on Jul. 9, 2009 and which claims benefit to German Patent Application No. 20 2008 012 816.1, filed on Sep. 26, 2008. The International Application was published in German on Apr. 1, 2010 as WO 2010/034533A1 under PCT Article 21(2).

FIELD

The present invention relates to an apparatus for filling prefabricated cigarette tubes having a housing, a tobacco chamber, a tobacco holder assigned to the latter, a movable pressing bar by means of which the tobacco introduced into the tobacco chamber is formed into a strand, an abutment for one end of the tobacco strand, the abutment being assigned to the tobacco holder, and a slider which can be moved relative to the housing to fill the cigarette tubes with the tobacco strand, wherein the length of the tobacco strand which is to be formed can be adapted to different filling-cavity lengths of cigarette tubes by virtue of the length of the pressing bar being changed.

BACKGROUND

DE 41 10 830 C1 describes an apparatus for filling prefabricated cigarette tubes. In order for this apparatus to adapt the length of the tobacco chamber to different filling-cavity lengths of cigarette tubes, the abutment is designed as a part which can be adjusted in the longitudinal direction of the tobacco holder and for which, corresponding to the number of different-length cigarette tubes which are to be filled, at least two predetermined latching positions are provided.

The disadvantage of this apparatus is that the adjustable configuration of the abutment renders it complex to produce. In addition, it has been found that, for the case where the user has accidentally moved the abutment into a position intended for a longer cigarette tube, in the case of a prefabricated filter tube, the tube is destroyed by overfilling, for example as a result of the filter being torn.

SUMMARY

An aspect of the present invention is to develop an apparatus for filling prefabricated cigarette tubes of the type described above with an improved functionality.

In an embodiment, the present invention provides an apparatus for filling a prefabricated cigarette tube which includes a housing, a tobacco chamber with a tobacco holder, and a movable pressing bar configured so as to form tobacco introduced into the tobacco chamber into a tobacco strand. An abutment for an end of the tobacco strand is assigned to the tobacco holder, wherein a first length of the to be formed tobacco strand is adjustable to prefrabicated cigarette tubes having different filling-cavity lengths by adjusting a second length of the pressing bar. A slider is configured to be moved relative to the housing so as to fill the prefabricated cigarette tube with the tobacco strand. The tobacco holder is displacably arranged relative to the abutment in a movement direction of the slider by a distance which approximately corresponds to the different filling-cavity lengths.

BRIEF DESCRIPTION OF THE DRAWINGS

The present invention is described in greater detail below on the basis of embodiments and of the drawings in which.

DETAILED DESCRIPTION

Figure 1:
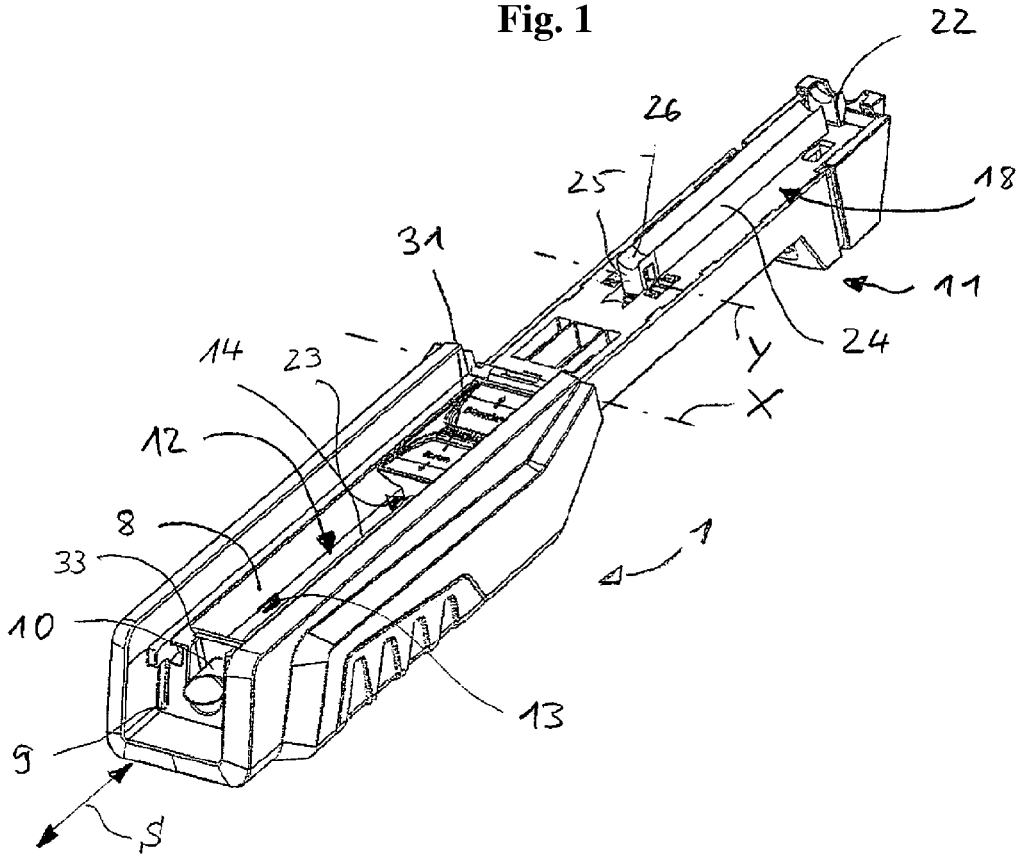
FIG. 1 shows a perspective view with the cover swung open.
Figure 2:
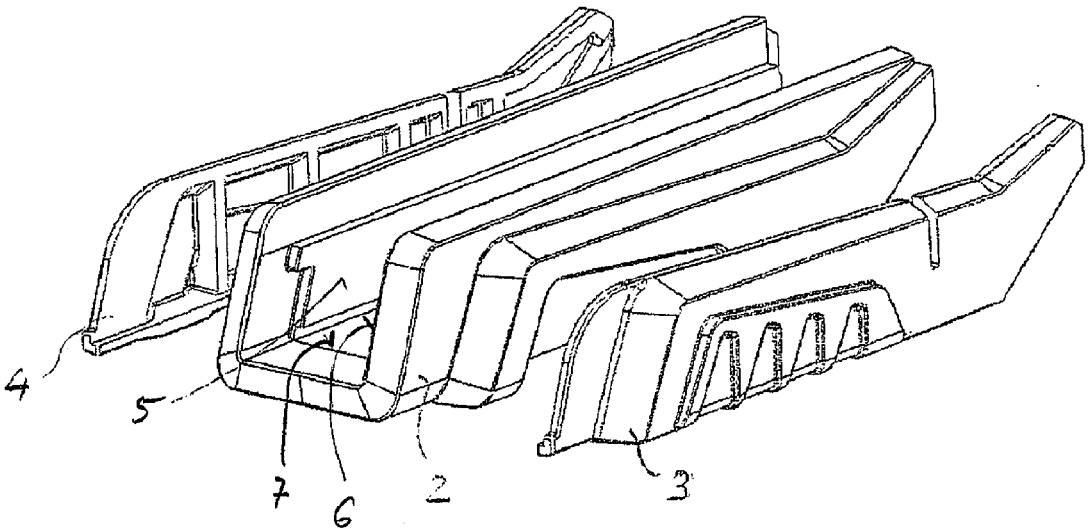
FIG. 2 shows the same view of the parts of the housing, this time in an exploded illustration.
Figure 3:
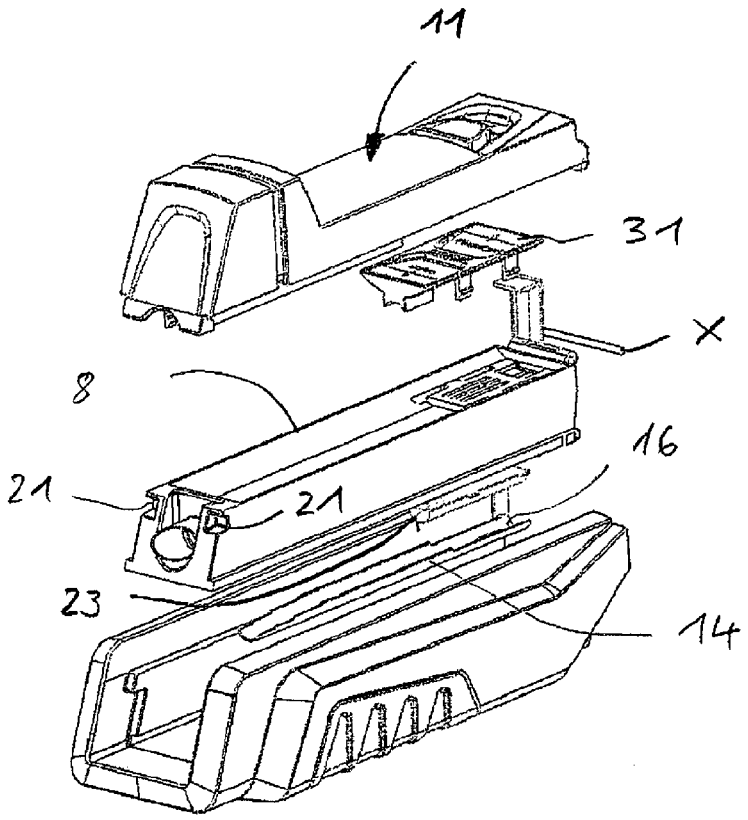
FIG. 3 shows the same view as in FIG. 1, but with the housing, tobacco holder, slider and cover illustrated individually, the cover being located in its closed position.
Figure 4:
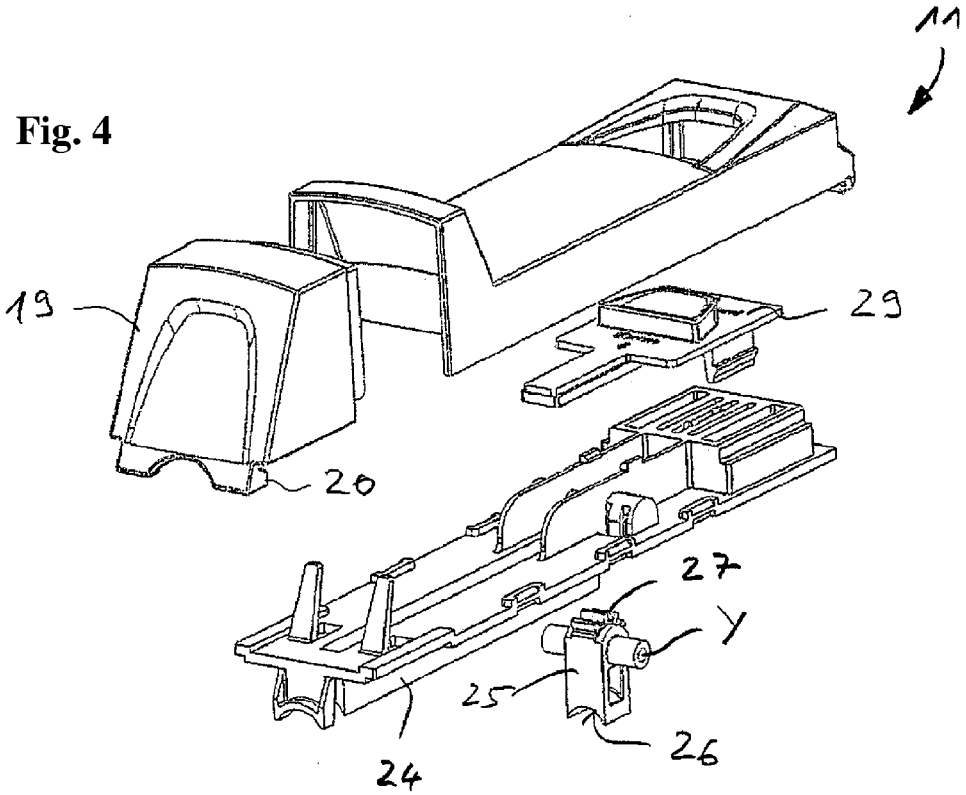
FIG. 4 shows the cover in a view according to FIG. 3, this time in an exploded illustration.

Since the tobacco holder is mounted such that it can be displaced relative to the abutment, in the movement direction of the slider, by a distance which corresponds approximately to the difference in length of the different filling-cavity lengths, it is no longer necessary for the abutment to be configured such that it can be adjusted and latched in certain positions. By virtue of the tobacco holder being arranged such that it can be displaced in the movement direction of the slider, it displaces itself automatically into a position in which the length available for the tobacco is shortened when there is a force acting in the displacement direction which exceeds the force fit of the tobacco holder in the housing, as is usually the case when that end of the tobacco holder which is directed away from the abutment comes into contact with the filter of a filter tube. This type of "floating" mounting of the tobacco holder means that the length of the tobacco chamber can be adapted automatically to the filling-cavity length of the cigarette tube.

In order for it to be possible to adapt the length of the pressing bar to the filling-cavity length of the cigarette tube used in each case, the pressing bar may comprise a fixed part and a movable part, which optionally supplements the pressing bar.

In an embodiment of the present invention, a configuration of the apparatus can, for example, be one in which the movable part of the pressing bar can be pivoted through approximately 90°, about an axis running perpendicularly to the movement direction of the slider, between a position in which it has been drawn back into the contour of the cover and a position in which it extends the pressing bar. This measure means that the movable part of the bar is not obtrusive, or disruptive to the operation of the apparatus according to the present invention, in any position since it appears either as a part of the pressing bar which increases the filling-cavity length or as a component which does not project out of the outer contour of the apparatus.

In order to make it possible for the user to displace the movable part straightforwardly between the drawn-back position and the position in which the movable part supplements the pressing bar, the fixed and the movable parts of the pressing bar are located on a cover which is articulated in a pivotable manner on the slider. This advancment means that both the tobacco chamber, for filling purposes, and the movable part of the pressing bar, for adapting the apparatus to different filling-cavity lengths, are particularly straightforward.

The actuation of the movable part of the pressing bar is simplified further if an actuating member for the movable part of the pressing bar is provided on the cover. This may, for example, comprise a toothing formation which engages with a toothing formation of the movable part of the pressing bar. This measure means that it is no longer necessary, for the purpose of displacing the movable part of the pressing bar, for the latter to be transferred directly from the one position into the other position, which poses particular problems, for example, when it is to be displaced out of the drawn-back position into the supplementary position; displacement can rather take place, for example, in an ergonomically advantageous manner, using the thumb, by actuation of the actuating member.

In order to convert the linear movement of the actuating member into the rotary movement of the movable part of the pressing bar, the actuating member and the pressing bar have interengaging toothing formations, the toothing formation of the slider being a linear toothing formation and that of the movable part being part of a gearwheel which has its axis of rotation coinciding with the axis about which the movable part of the pressing bar can be pivoted.

In order for it to be possible for the quantity of tobacco fed to the tobacco chamber to be adapted more easily to the filling-cavity length of the cigarette tube used in each case, the tobacco chamber can, for example, be assigned a covering with which optionally that region of the tobacco chamber which is adjacent to the abutment can be covered over a length which corresponds approximately to the difference in length of the different filling-cavity lengths. In the position in which a certain length of the tobacco chamber is covered, the volume located beneath the covering is at least substantially not filled during introduction of the tobacco, and therefore overfilling of the front cavity of the cigarette tube, or undesirably pronounced compression of the tobacco, is reliably avoided.

In an embodiment of the present invention, the covering can, for example, be arranged in the tobacco chamber such that it can be displaced in the movement direction of the slider, since the actuating directions of all the devices of the apparatus thus coincide with the movement direction of the slider. This renders the handling of the apparatus according to the present invention particularly intuitive and straightforward for the user.

For the purpose of securing a cigarette tube during the filling operation, the apparatus according to the present invention may comprise a bushing which can be arranged at that end of the slider which is opposite to the abutment, the bushing having an external diameter which corresponds approximately to the internal diameter of a cigarette tube and having substantially cylindrical inner volume. During the filling operation, the cigarette tube, then, is retained on the bushing by a protrusion, which is provided on the cover and acts on the cigarette-tube material from the outside, and drawn over the tobacco strand, which is located in the tobacco chamber and passes through the inner volume of the bushing during this displacement or filling operation.

The bushing can be fitted particularly straightforwardly on the slider if the bushing—is, for example, formed on a retaining plate which extends approximately perpendicularly to the longitudinal axis of the bushing. The slider, for example, then has two grooves which are arranged opposite one another on its side and into which the retaining plate can be pushed by way of its lateral peripheries. This design measure allows not just for particularly straightforward fitting of the bushing, but also for easy exchangeability in the event of damage. The bushing may furthermore be produced from a material which differs from that of the slider and has material properties which are particularly suitable, for example, for retaining the cigarette tube and for through-passage of the tobacco strand.

The operation of bushing a cigarette tube onto the bushing is facilitated if the free end of the bushing, this end being located opposite the retaining plate, is beveled laterally.

In an embodiment of the present invention, the bushing is one in which its inner volume, at the end region located opposite the free end, comprises a region which widens in the direction of the tobacco chamber. It has surprisingly been found that, on account of this measure, lower forces are necessary for carrying out the filling operation than if the inner volume of the bushing were of completely cylindrical design. The effect brought about by the widening region is particularly surprising insofar as the tobacco strand has already been preformed within the tobacco chamber on account of the pressure applied by the pressing bar. This particular configuration of the bushing thus also has inventive importance in its own right irrespective of whether the apparatus comprising such a bushing has the previously described features or not.

The region which widens in the direction of the transporting chamber may be of conical design. It can, for example, be designed to widen in a curved manner.

The apparatus, which is designated as a whole by 100 in the figures, comprises a housing 1 with a basic part 2 and with lateral grip parts 3, 4 inserted and latched therein. Both the basic part 2 and the lateral grip parts 3, 4 can be produced from a plastic material. The grip parts 3, 4 may be produced from a softer material than the basic part 2 and in a different color, in order to thus improve the visual appearance of the apparatus and to make it more convenient to handle.

A slider 8 is guided straightly in the movement direction S in the basic part 2 of the housing 1, between the inner side walls 5, 6 thereof and the base wall 7 thereof. For the purpose of fixing the slider 8 perpendicularly to the base wall 7, the slider 8 comprises, on either side, protrusions 9 which form an extension of the underside and engage in complementary grooves in the side walls 5, 6.

A bushing 10 is provided on the slider 8 at the end which is illustrated on the left-hand side in the drawing, and is referred to hereinbelow as the front end, the bushing having an external diameter which is adapted to the internal diameter of a prefabricated cigarette tube such that the latter can be pushed onto the bushing 10 without a particularly large amount of play. In order to make it easier for the cigarette tube to be pushed on, the free end of the bushing 10 is beveled laterally.

The bushing 10 is formed on a retaining plate 32 by way of its end which is located opposite the laterally beveled, free end. For the purpose of fastening the bushing 10 with the retaining plate 32, the slider 8 contains the groove 33 (see FIG. 1) into which the retaining plate can be pushed by way of its lateral peripheries 34. In order to avoid the situation where the retaining plate 32 accidentally comes out of the groove 33 of its own accord, but also while maintaining simultaneously straightforward insertability, extensions 36, which project in a hook-like manner, are provided on the lateral periphery 34, and these extensions interact in clamping fashion with the bases of the grooves 33.

Figure 7:
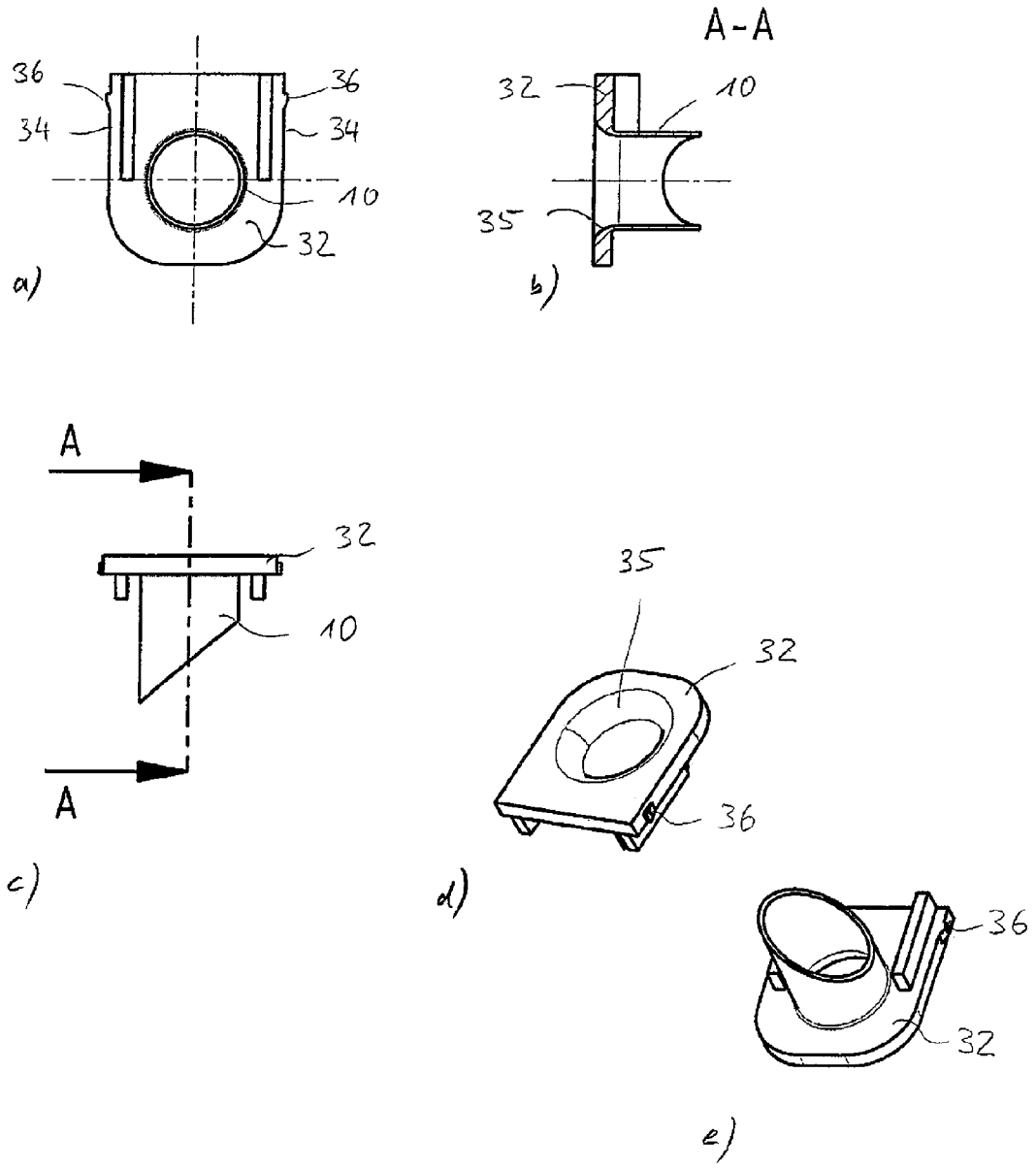
FIG. 7*a* to e show various views of the bushing with retaining plate.

As can be seen in particular from FIG. 7*b* and FIG. 7*d*, the inner volume of the bushing 10, at the end region located opposite the free end, comprises a region 35 which widens in the direction of the tobacco chamber 13. It has surprisingly been found that, as a result of this widening, the actuating forces which have to be applied for displacing the slider and basic part in relation to one another for the purpose of filling a cigarette tube are reduced in relation to a conventional, purely cylindrical configuration of the inner volume of the bushing.

At the rear end of the housing, this end being illustrated on the right-hand side in the drawing, a cover 11 is articulated on the slider 8 such that it can be pivoted about a horizontal axis X running perpendicularly to the movement direction S.

The slider has an elongate recess 12, as seen in the movement direction S, which forms a tobacco chamber 13 and extends all the way through the slider in the vertical direction.

The base of the tobacco chamber 13 is formed by a tray-like tobacco holder 14 which butts laterally more or less against the side walls of the recess 12 and of which the lateral peripheries are covered over by longitudinal protrusions 15 in the tobacco chamber, thus avoiding the situation where tobacco passes between the lateral peripheries of the tobacco holder and the walls of the recess 12.

The tobacco holder 14 is produced from a dimensionally stable material, for example metal, and is fitted in the rear region 16, which projects out of the tobacco chamber 13, on a pedestal 17 provided on the base wall 7 of the basic part 2. This gives sufficient play between the underside of the tobacco holder 14 and the base wall 7 for it to be possible for the tobacco holder 14 to pass through the bushing 10 without obstruction when the slider 8 is displaced rearward.

A pressing bar 18 is formed on the lower side of the cover 11, as seen in the closed state of the latter, and that side of the pressing bar which is oriented downward in the closed state is of hollow design, approximately with the same radius as the tobacco holder 14. Furthermore, the pressing bar 18 is dimensioned such that, together with the side walls of the recess 12 and the tobacco holder 14, it closes off the tobacco chamber 13 in the upward direction in the closed state such that the tobacco chamber is approximately round in cross section.

At the front end region of the cover, as seen in the closed state, the cover has fitted on it a handgrip 19 which can be displaced rearward counter to an elastic force. The handgrip has two extensions 20 which, when the handle has been displaced rearward counter to the elastic force, engage in complementary recesses 21 of the slider 8. The engagement of the extensions 20 in the recesses 21 arrests the cover against swinging up about the axis X.

For the purpose of filling a prefabricated cigarette tube with tobacco, with the cover 11 open, the tobacco chamber 13 is filled loosely with tobacco. The open end of the prefabricated cigarette tube is then pushed onto the bushing 10 and the cover 11 is closed by virtue of being pivoted about the axis X. The cigarette tube (not illustrated in the drawing) is held in position on the bushing in that a pressure-exerting block 22 provided in the front region of the cover 11 presses the tube material, over part of its circumference, against the bushing 10. In the closed position of the cover, the latter is arrested, by virtue of the handle 19 being actuated and the extensions 20 engaging in the recesses 21, and then the cover is displaced rearward together with the slider, wherein the cigarette tube is drawn over the tobacco holder 14 and the tobacco is retained by an abutment 23, which forms the rear end of the tobacco chamber 13, and the cigarette tube is thus drawn over the tobacco strand located in the tobacco chamber 13.

Figure 5:
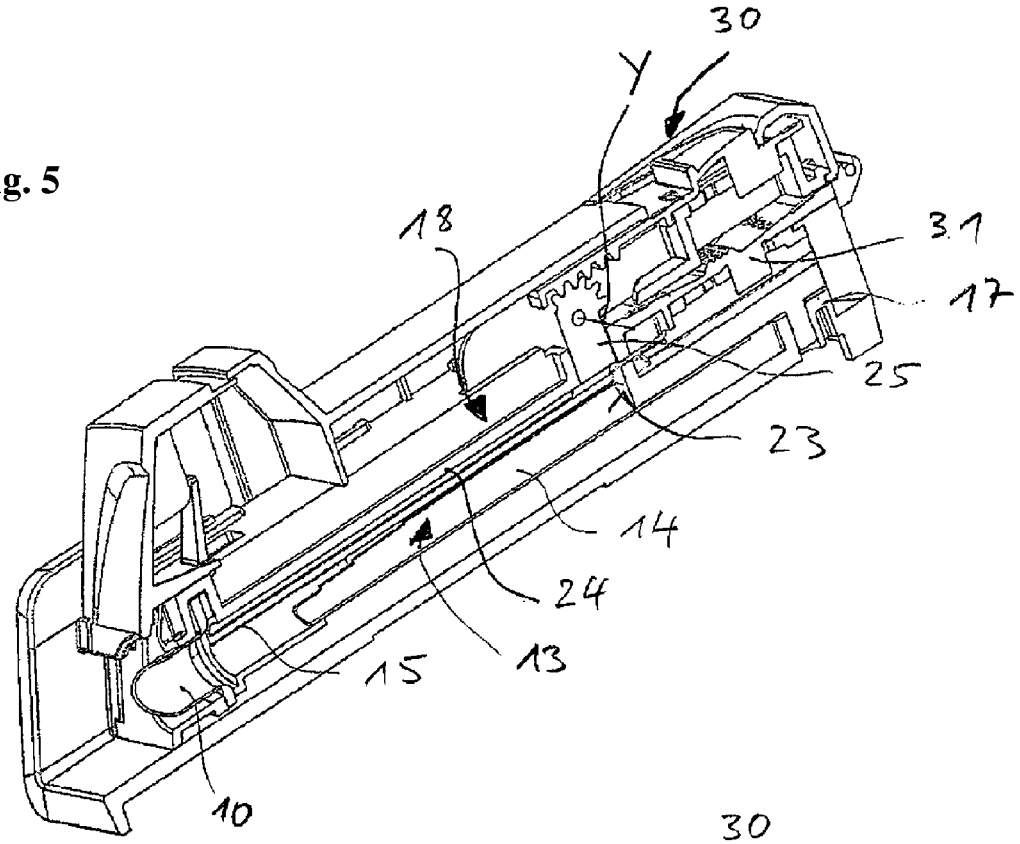
FIG. 5 shows a perspective longitudinal section through the apparatus set with cigarette tubes with a long filling cavity.

In order for it also to be possible to use the apparatus to fill cigarette tubes with tobacco-receiving volumes of two different lengths, the length of the pressing bar 18 can be changed. For this purpose, the pressing bar 18 has a fixed part 24 and a movable part 25, which optionally supplements the pressing bar 18. The movable part can be pivoted in the cover 11, on that side of the fixed part 24 which is directed toward the axis X, through approximately 90°, about an axis Y running perpendicularly to the movement direction S of the slider and parallel to the axis X, between a position in which it has been drawn back into the contour of the cover 11 (see FIG. 6) and the position in which it extends the pressing bar 18 (see FIG. 5).

In order for it to be possible to carry out the pivoting movement, that end region of the removal part 25 which is located opposite the pressing surface 26 is provided with a toothing formation 27 extending over an angle of approximately 100°.

Figure 6:
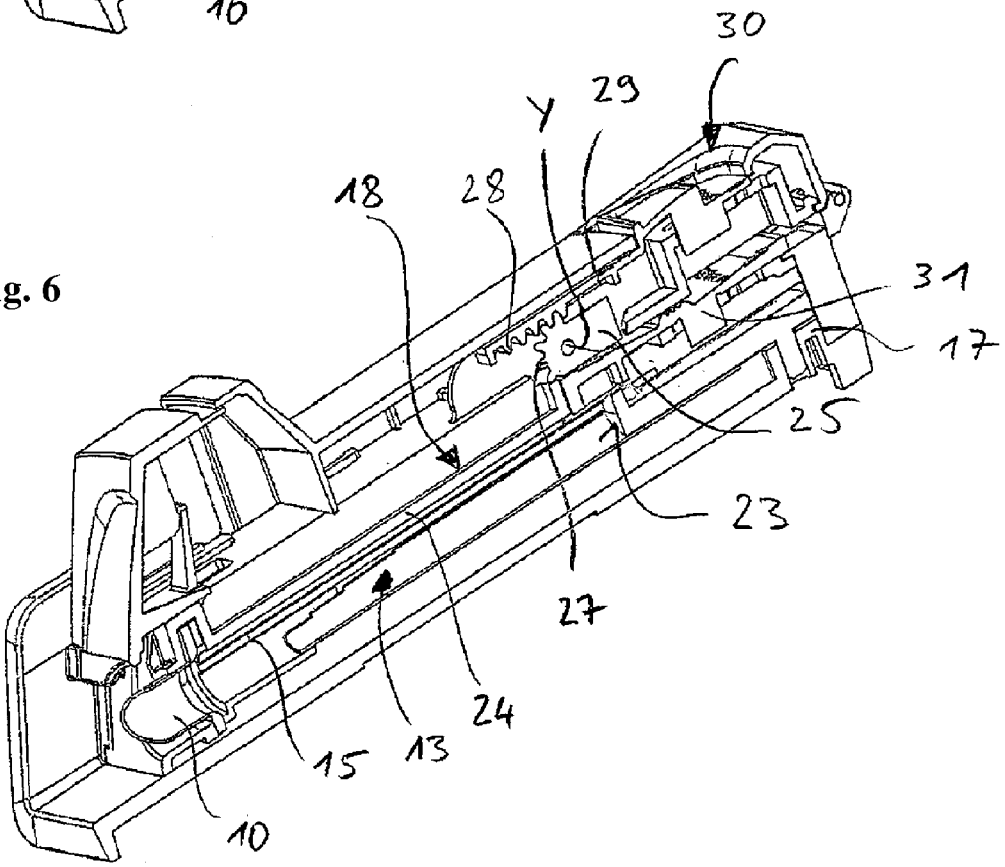
FIG. 6 shows the same view as in FIG. 5, this time adapted to cigarette tubes of shorter filling-cavity length.

The toothing formation 27 engages with a linear toothing formation 28 of an actuating member 29, which is mounted within the cover 11 such that it can be displaced perpendicularly to the axis Y and which can be displaced manually, through an aperture 30 in the cover 11, by a distance which is necessary for it to be possible to displace the movable part 25 of the pressing bar 18 between the position in which it extends the pressing bar 18 (illustrated in FIG. 5) and the position in which it has been retracted into the contour of the cover 11 (illustrated in FIG. 6).

In order that, in the case of filling a cigarette tube of short filling-cavity length corresponding to the length of the fixed part 24 of the pressing bar 18, the tobacco holder 14 does not project beyond the filling-cavity length, which can result, in particular, in the case of filter tubes, in the latter being torn off the bushing 10 or being destroyed, the tobacco holder 14 is mounted on the pedestal 17 such that it can be displaced relative to the abutment 23, in the movement direction S of the slider 8, by a distance which corresponds to the difference in length of the different filling-cavity lengths or to the length by which the pressing bar 18 can be extended or shortened by the movable part 25.

This "floating" mounting of the tobacco holder 14 means that, during the filling operation, the holder is displaced automatically into the rear position by the friction with the tube and the tobacco strand located in the tobacco chamber, and therefore, at the end of the filling operation, even cigarette tubes of short filling-cavity length cannot be damaged, and, upon backward displacement of the slider for the purpose of drawing the filled tube off from the tobacco holder 14, the latter is displaced into the drawn-out position again and is thus available for a further filling operation of the tobacco chamber 13, even for cigarette sleeves of long filling-cavity length.

In order to avoid the situation where, in the case of cigarette tubes of short filling-cavity length being filled, the tobacco strand is compressed to an undesirably pronounced extent during the filling operation, the slider 8 has provided on it a covering 31 which is assigned to the tobacco chamber 13 and with which optionally that region of the tobacco chamber 13 which is adjacent to the abutment 23 can be covered over a length which corresponds to the difference in length of the different filling-cavity lengths or to the change in length of the pressing bar 18 which can be brought about by the movable part 25. For the case where a cigarette tube of long filling-cavity length is to be filled, the covering is displaced into the position in which it releases the entire volume of the tobacco chamber 13 (illustrated in FIG. 5). If a cigarette tube of shorter filling-cavity length is to be filled, then, prior to the tobacco being introduced into the tobacco chamber 13, the covering 31 is moved toward the bushing 10 into the position which is illustrated in FIG. 6.

The present invention is not limited to embodiments described herein; reference should be had to the appended claims.

List of Designations

100 Apparatus
1 Housing
2 Basic part

3 Grip part
4 Grip part
5 Side wall
6 Side wall
7 Base wall
8 Slider
9 Protrusions
10 Bushing
11 Cover
12 Recess
13 Tobacco chamber
14 Tobacco holder
15 Lateral protrusions
16 Region
17 Pedestal
18 Pressing bar
19 Handle
20 Extensions
21 Recesses
22 Pressure-exerting
23 Block
24 Fixed part
25 Movable part
26 Pressing surface
27 Toothing formation
28 Linear toothing
29 Actuating member
30 Aperture
31 Covering
32 Retaining plate
33 Grooves
34 Peripheries
35 Regions
36 Extensions
S Movement direction
X Axis
Y Axis

The invention claimed is:

1. An apparatus for filling a prefabricated cigarette tube, the apparatus comprising:

a housing;

a tobacco chamber with a tobacco holder;

a movable pressing bar configured so as to form tobacco introduced into the tobacco chamber into a tobacco strand;

an abutment for an end of the tobacco strand, the abutment being assigned to the tobacco holder, wherein a first length of the to be formed tobacco strand can be adjusted to prefabricated cigarette tubes having different filling-cavity lengths by adjusting a second length of the pressing bar; and a slider configured to be moved relative to the housing so as to fill the prefabricated cigarette tube with the tobacco strand, wherein the tobacco holder is displacably arranged relative to the abutment in a movement direction of the slider by a distance which approximately corresponds to the different filling-cavity lengths.

2. The apparatus as recited in claim 1, wherein the pressing bar comprises a fixed part and a movable part configured to allow extension of the pressing bar.

3. The apparatus as recited in claim 2, further comprising a cover with a contour, wherein the movable part of the pressing bar is arranged so as to pivot through approximately 90° about an axis Y running perpendicularly to the movement direction of the slider, between a position in which the moveable part has been drawn back into the contour of the cover and a position where the movable part extends the pressing bar.

4. The apparatus as recited in claim 3, wherein the cover is hinged on the slider to pivot about an axis X perpendicular to the movement direction.

5. The apparatus as recited in claim 3, further comprising an actuating member disposed on the cover for the movable part of the pressing bar.

6. The apparatus as recited in claim 5, wherein the actuating member comprises a linear toothing and the movable part of the pressing bar comprises a toothing formation, and the linear toothing is configured to engage with the toothing formation.

7. The apparatus as recited in claim 1, further comprising a covering assigned to the tobacco chamber, the covering being configured to cover a third length of a region of the tobacco chamber adjacent to the abutment, the third length corresponding approximately to the different filling-cavity lengths.

8. The apparatus as recited in claim 7, wherein the covering is arranged on the slider to be displacable in the movement direction.

9. The apparatus as recited in claim 1, further comprising a bushing with a free end disposed at an end of the slider opposite to the abutment, the bushing having a substantially cylindrical inner volume and an external diameter which corresponds approximately to an internal diameter of the prefabricated cigarette tube.

10. The apparatus as recited in claim 9, wherein the bushing is formed on a retaining plate extending perpendicular to a longitudinal axis of the bushing.

11. The apparatus as recited in claim 10, wherein the slider comprises a first groove and a second groove arranged opposite to each other on a respective side of the slider, the first groove and the second groove being configured so that lateral peripheries of a retaining plate can be pushed therein.

12. The apparatus as recited in claim 10, wherein the free end of the bushing arranged opposite to the retaining plate is laterally beveled.

13. The apparatus as recited in claim 9, wherein an inner volume of the bushing, located at an end region opposite the free end, comprises a region which widens in a direction of the tobacco chamber.

14. The apparatus as recited in claim 13, wherein the region which widens in a direction of the tobacco chamber has a conical shape.

15. The apparatus as recited in claim 13, wherein the region which widens in a direction of the tobacco chamber widens in a curved manner.

* * * * *